United States Patent [19]

Harris et al.

[11] 4,317,502

[45] Mar. 2, 1982

[54] ENGINE EXHAUST MUFFLER

[76] Inventors: Theodore R. Harris, 14 El Patio, Orinda, Calif. 94563; Richard T. Harris, 1040 Brown Ave., Lafayette, Calif. 94549

[21] Appl. No.: 207,729

[22] Filed: Nov. 17, 1980

Related U.S. Application Data

[63] Continuation-in-part of Ser. No. 86,776, Oct. 22, 1979, abandoned.

[51] Int. Cl.[3] ..... F01N 1/12

[52] U.S. Cl. ..... 181/280

[58] Field of Search ..... 181/279–280

[56] References Cited

U.S. PATENT DOCUMENTS

| | | | |
|---|---|---|---|
| 1,612,584 | 12/1926 | Hunter et al. | 181/279 |
| 3,235,003 | 2/1966 | Smith | 165/135 |
| 4,050,539 | 9/1977 | Kashiwara et al. | 181/280 |
| 4,109,753 | 8/1978 | Lyman | 181/252 |
| 4,165,798 | 8/1979 | Martinez | 181/268 |

FOREIGN PATENT DOCUMENTS

| | | | |
|---|---|---|---|
| 23743 | 7/1935 | Australia | 181/280 |
| 1301824 | 8/1969 | Fed. Rep. of Germany | 181/280 |
| 804593 | 8/1936 | France . | |
| 1087417 | 8/1954 | France . | |
| 641878 | 7/1962 | Italy | 181/280 |
| 266706 | 4/1928 | United Kingdom . | |
| 297871 | 4/1928 | United Kingdom . | |
| 426897 | 3/1935 | United Kingdom . | |

*Primary Examiner*—L. T. Hix
*Assistant Examiner*—Thomas H. Tarcza
*Attorney, Agent, or Firm*—James R. Cypher

[57] ABSTRACT

A muffler for automobile internal combustion engines consisting briefly of a housing having an inlet end where the exhaust gases are channeled through a tubular member having a helical member so that the gases are forced into a spiral flow pattern. The helical member extends beyond the end of the tubular member so that the gases are then permitted to follow a larger spiral pattern where they reflect against the walls of the housing. The housing has an outlet opening which is smaller than the housing diameter which causes compression of the gases and further reflection and interference of the sound waves. The muffler is formed with a counterflow reverberation chamber, a central chamber and a directional-flow reverberation chamber.

10 Claims, 14 Drawing Figures

ENGINE EXHAUST MUFFLER

BACKGROUND OF THE INVENTION

This invention is a continuation-in-part of my application entitled EXHAUST MUFFLER FOR INTERNAL COMBUSTION ENGINE, Ser. No. 086,776 filed Oct. 22, 1979, now abandoned.

This invention relates to mufflers for internal combustion engines mounted in automobiles and trucks and for stationary engines.

The classifiers have divided all mufflers into two general classifications; (1) reactive types, and (2) dissipative types. In the reactive type muffler, noise damping is effected by phase opposition. In other words, if a rarefaction of one sound wave arrives with a compression of the other, their effect partly or wholly cancel and the sound is faint. An example of a reactive type muffler is Martinez, U.S. Pat. No. 4,165,798 granted Aug. 28, 1979.

Dissipative mufflers, on the other hand, absorb sound. As a wave motion passes through a medium, some of the regular motion of particles in the wave motion is converted into irregular motion, (heat). This constitutes absorption of energy from the wave. An example of a dissipative muffler is Lyman, U.S. Pat. No. 4,109,753. Here, the muffler housing is packed with fiber glass.

A combination of reactive and dissipative principles is set forth in Smith, U.S. Pat. No. 3,235,003 granted Feb. 15, 1966 where the exhaust gases are forced to follow two separate helical paths while some of the gas is dissipated in the fiber glass packed housing.

Reactive type mufflers create a power robbing loss due to an increase in exhaust back pressure. Therefore in an effort to obtain more engine power, a series of patented devices have been devised to actually reduce back pressure while performing some sound attenuation. While back pressure has undoubtedly been reduced, these devices cannot meet stringent noise level standards; particularly those adopted in the state of California.

A list of patents designed to create low back pressure follows: U.S. Pat. No. 1,612,584 Dec. 28, 1926 Hunter, Great Britain Pat. No. 266,706 March 1928, Great Britain Pat. No. 422,004 January 1935, Great Britain Pat. No. 426,897 April 1935, France Pat. No. 804,593 August 1936, France Pat. No. 1,087,417 August 1954, U.S. Pat. No. 4,050,539 Sept. 27, 1977 Kashiwara and Ichimaru.

The above low back pressure patented devices achieve this result by the use of large helical members which extend to the outer walls of the housing.

In studying the above patents, it is apparent that the use of helical members in automobile mufflers achieve the objective of low back pressure, but fail to meet the present low noise standards unless they are also packed with a sound absorbing material such as fiber glass as shown in Smith, supra. Kashiwara and Ichimaru, supra recognized the need for a separate muffler to attenuate sound with their helical flow device (See FIG. 2).

MUFFLERS WITH HELICAL MEMBERS BUT WITHOUT SOUND ABSORBING MATERIAL

Norman, Australia Pat. No. 23,743, July 30, 1935, discloses a muffler containing a helical member. Part of the gases travel the entire length of the muffler within the helical member and part of the gases escape through an elongated slit. There are no reverberation chambers. It is doubtful that this muffler would be permitted in the United States since exhaust gases escape directly from the muffler instead of the necessary tail pipe which extends beyond the rear bumper of the car. The device shown in FIGS. 1–3 of Norman would most probably fail in use since the helix is affixed to the front as well as the rear of the casing. Heat expansion would, in time, cause any welds to fail at one end. With the helix loose at one end, it would undoubtedly cause considerable vibration noise.

Kolhonen, West German Pat. No. 1,301,824, granted Aug. 28, 1969, teaches a plurality of spirally shaped helixes in a muffler. Kolhonen also teaches the use of reverberation chambers but the helixes are always totally enclosed by tubes. There is no unenclosed helix extending into a reverberation chamber. It is believed that this muffler is inoperable except for very small displacement engines not used in American automobiles because the helix in the exit tube would cause an excessive backpressure.

Guilla, Italian Pat. No. 641,878 granted July 3, 1962 teaches the use of a plurality of spiral strips. Again the spiral strips are totally enclosed except for a very short portion before the strips enter the enclosure tubes. As stated above, it is believed that the muffler is inoperable in American cars because of excess back pressure caused by the helixes filling the exit tubes. This patent does not teach the extension of a non-enclosed helix in a central reverberation chamber. Further, Guilla packs chamber 8 with a sound absorbing material such as fiber glass. Guilla is a dissipative type muffler.

Austin, United Kingdom, Pat. No. 297,871, complete accepted Oct. 1, 1928 teaches the use of wire formed in a helix in a muffler. Exhaust gases first enter a large open chamber and then exit through the exhaust pipe filled with the wire formed helix. The muffler would undoubtedly create an excess back pressure as stated above and not be usable on any automobiles presently in use in the United States.

The problem of designing a muffler for a particular car is a very difficult matter. (See J. H. Venema, Ford Motor Company, Surface Transportation Noise, *Transportation Noises* University of Washington Press, Copyright 1970, Library of Congress Catalog Card Number 74-115414). According to Mr. Venema, there is a wide disparity between the noise a vehicle makes at constant speed and the noise made at wide open throttle. Even low road speeds in low gear can produce "unreal sound levels" due to the overheated exhaust system.

All original muffler systems corrode and need to be replaced long before the automobile wears out. There is a substantial "after market" industry in the United States. Since no individual shop can carry original mufflers specifically designed for each individual automobile, the design of an "after market" muffler which can be attached to most makes of cars, meet the California standards for noise control, provides low back pressure, and economically produced thus presents a formidable task.

SUMMARY OF THE INVENTION

The present invention can be attached to most makes of cars, meets the low noise standards of the state of California, provides low back pressures and can be economically produced. All of these objectives, surprisingly, are attained with a device which has heretofore been associated only with low back pressure devices which heretofore could never achieve good noise attenuation.

Further, the above objectives have been attained with a device which requires no sound absorbing materials such as fiber glass.

Still another objective of the present invention is to manufacture a few basic types of mufflers, all using the same basic components, which can effectively meet the California noise standards for almost all of the presently manufactured automobiles.

Another objective is to provide an automobile muffler which is relatively small so that it will fit the downsized automobiles and light weight so that it will not penalize gas mileage.

Still another objective is to provide a muffler which will not clog with unburned hydrocarbons.

Another objective is to provide a muffler in which all of the parts may be constructed so that it is less subject to corrosion.

Still another object is to provide a muffler which uses the same basic components for large as well as small engines.

DESCRIPTION OF THE DRAWINGS

Referring to FIGS. 1 through 3, the internal combustion engine muffler 65 consists of an elongated oval shaped housing 66 having an inlet opening 67 and an outlet opening 68. Within the housing there is a counter flow reverberation chamber 69 which is open at one end only, a double open ended central chamber 70 in communication with the counter flow reverberation chamber and a directional-flow reverberation chamber 71 having a closed end and an open end in communication with the central chamber. The muffler includes a first gas flow channeling member 72 which includes an elongated tubular member 73 having a diameter and a length less than the smallest cross sectional dimension and length of the elongated housing and having an inlet end 74 in communication with the inlet opening of the housing and an outlet end 75 in communication with the central chamber. Mounted within the tubular member is an elongated rod member 76 having a diameter less than the diameter of the elongated tubular member. A helix member 77 is connected to the rod member and has an outer diameter substantially equal to the inside diameter of the elongated tubular member and extends along a substantial portion of the tubular member and extends a substantial distance beyond the downstream end of the tubular member into the mid-portion of the central member. The helix portion extending into the central chamber is indicated by the number 78. A second gas flow channeling member 79 is positioned parallel to the first gas flow channeling member and also consists of an elongated tubular member 80 having a diameter and a length less than the smallest cross sectional dimension and length of the elongated housing and has an inlet end 81 in communication with the inlet opening of the housing and an outlet end 82 in communication with the central chamber. An elongated rod member 83 having a diameter less than the diameter of the elongated tubular member is positioned within tubular member 80. A helix member 84 is connected to the rod member 83 and has an outer diameter substantially equal to the inside diameter of the elongated tubular member and extends along a substantial portion of the tubular member and has a portion 85 which extends a substantial distance beyond the downstream end of the tubular member and into the mid-portion of the central chamber. Helix extension portion 85 is mounted on rod extension 86. Helix extension 78 is mounted on rod extension 87.

An inflow means, which here consists of a plate 89 connects the gas flow channeling members 72 and 79 to the housing 66 and causes the entire flow of exhaust gases from the internal combustion engine entering through inlet tube 88 to flow through the gas flow channeling members.

Figure 1:
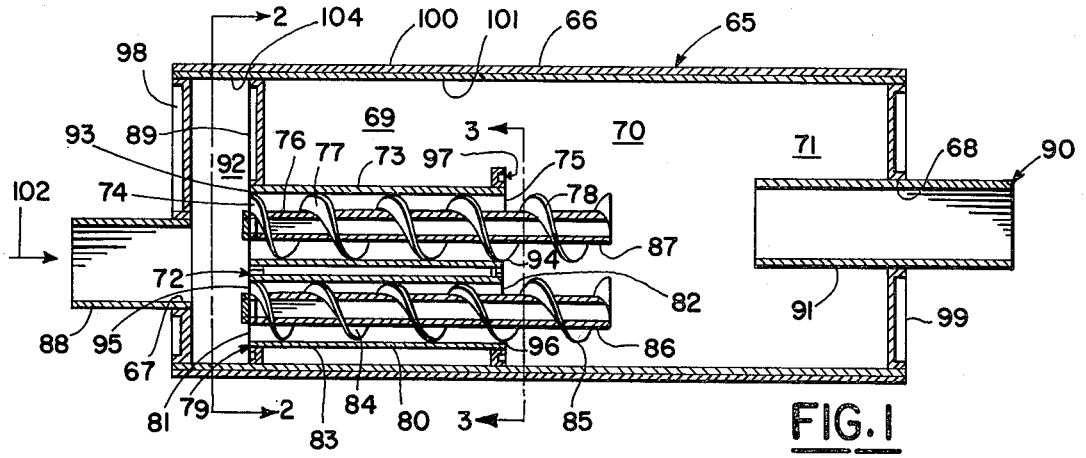
FIG. 1 is a plan view of a muffler constructed in accordance with the present invention.

An out flow tubular member 90 is connected to the housing at the outlet opening and has an extension portion 91 which extends through the directional flow reverberating chamber 71 and communicates with the central chamber 70. As shown in FIG. 1, the inflow means 89 is connected to the housing at a location spaced from the inlet opening forming a pre-chamber 92.

The helix member 77 is force fit within the tubular member 73 and may be connected thereto by spot welding at end 93 and at end 94. In like manner, helix 84 is force fit in tubular member 80 and is connected thereto by spot welding at end 95 and end 96. The outlet ends 75 and 82 of tubular members 73 and 80 are connected to the housing 66 by means of plate member 97. The connection may be by spot welding.

Front plate 98 and rear plate 99 enclose the ends of the muffler housing 66.

Figure 2:
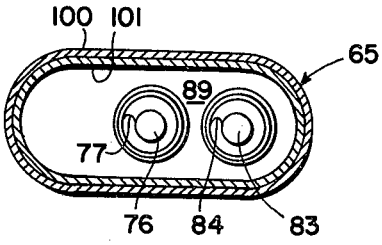
FIG. 2 is a cross sectional view taken along line 2—2 of FIG. 1.
Figure 3:
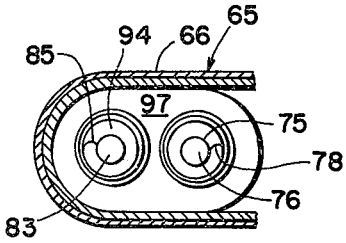
FIG. 3 is a cross sectional view taken along line 3—3 of FIG. 1.

The housing is constructed with an oval shape as shown in FIGS. 2 and 3 and preferably is formed with double wall members 100 and 101.

Referring to FIGS. 1 and 3, the tubular members 73 and 80 are connected to plate 97 as by force fit and spot welding and the perimeter of the plate is connected to the inside walls of the muffler housing as by spot welding. Preferably plate 97 is connected to the tubular members at or near their ends.

In operation, the muffler of FIGS. 1 through 3 is attached to the exhaust system of an automobile with the exhaust moving in the direction of arrow 102 through inlet tube 88.

The gases first enter pre-chamber 92 and a portion enter first and second gas flow channeling members 72 and 79. A portion of the gas expands into the pre-chamber and is reflected off the oval side walls 104. Some of the gas also reflects from walls 98 and 89 before entering the gas flow channeling members. In the pre-chamber, the gases expand and contract as well as mix with the incoming and outgoing gases.

As the gases pass through the gas flow channeling members, they follow the helical path of helical members 77 and 84. As the gases exit the ends 75 and 82 a portion of the gases expand into open ended chamber 70 while a portion of the gases continue their forward momentum and pass directly out outlet extension 91. Most of the gases, however, continue through to reverberation chamber 71 where they strike rear plate 99. The gases are reflected back through chamber 70 where some strike outlet extension 91, side walls 101 and then meet the expanding gases newly exiting from gas flow channeling members 72 and 79. While some of the gases will be driven back to rear plate 99 or out outlet extension 91, some of the gas will strike plate 97 and other portions of the gas will move to counter-flow reverberation chamber 69 where they will strike plate 89. The flow of the gases again will be reversed and flow through open ended chamber 70 where they will again mix with new flow gases exiting gas flow channeling members 72 and 79. Eventually the gases will exit through outlet extension 91 after considerable mixing and reflection off the walls of the three chambers.

EMBODIMENT OF FIGS. 4–6

Figure 5:
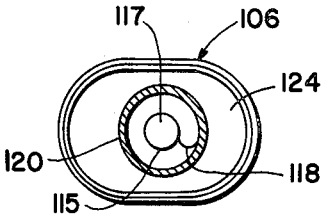
FIG. 5 is an end view of the device shown in FIG. 4.
Figure 6:
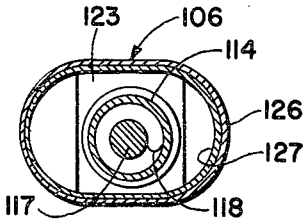
FIG. 6 is a cross sectional view taken along line 6—6 of FIG. 4.
Figure 4:
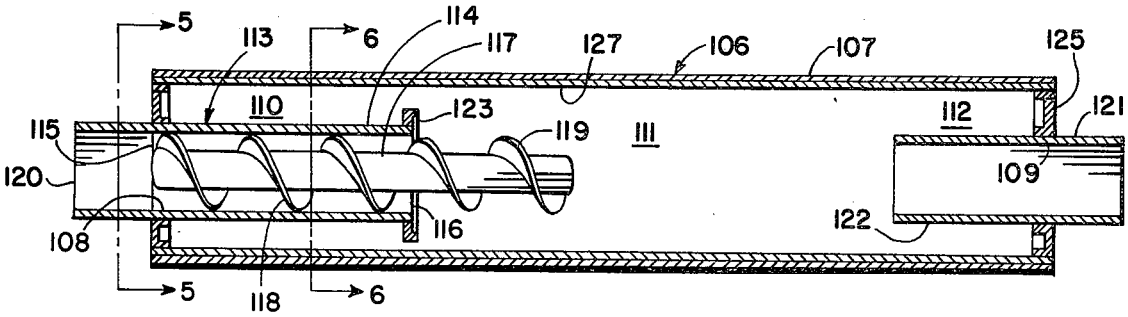
FIG. 4 is a cross sectional view of an alternate form of the invention.

The embodiment of the internal combustion engine muffler 106 illustrated in FIGS. 4–6 consists of an elongated oval shaped housing 107 having an inlet opening 108 and an outlet opening 109. Within the housing there is a counter-flow reverberation chamber 110 which is open at one end only, a double open ended central chamber 111 in communication with the counter-flow reverberation chamber and a directional-flow reverberation chamber 112 having a closed end and an open end in communication with the central chamber. The muffler includes a first gas flow channeling member 113 which includes an elongated tubular member 114 having a diameter and a length less than the smallest cross sectional dimension and length of the elongated housing and having an inlet end 115 in communication with the inlet opening of the housing and an outlet end 116 in communication with the central chamber. Mounted within the tubular member is an elongated rod member 117 having a diameter less than the diameter of the elongated tubular member. A helix member 118 is connected to the rod member and has an outer diameter substantially equal to the inside diameter of the elongated tubular member and extends along a substantial portion of the tubular member and extends a substantial distance beyond the downstream end of the tubular member into the mid-portion of the central chamber. The helix portion extending into the central chamber is indicated by the number 119.

An inflow means which here consists of a tubular pipe 120 is connected to the housing 107 and causes the entire flow of exhaust gases from the internal combustion engine to flow through the gas flow channeling member.

An out flow tubular member 121 is connected to the housing at the outlet opening and has an extension portion 122 which extends through the directional-flow reverberating chamber 112 and communicates with the central chamber 111.

The helix member 118 is force fit within the tubular member 114 and may be connected thereto by spot welding at end 115 and at end 116. The outlet end 116 of tubular member 114 is connected to the housing 107 by means of plate member 123. The connection may be by spot welding.

Front plate 124 and rear plate 125 enclose the ends of the muffler housing 107. The housing is preferably constructed with an oval shape as shown in FIGS. 5 and 6 and preferably is formed with double wall members 126 and 127.

Operation of the muffler is nearly identical to the embodiment shown in FIGS. 1–3 except that there is no pre-chamber and there is only a single gas flow channeling member.

EMBODIMENT OF FIGS. 7–10

Referring specifically to FIGS. 7–10 an alternate form of the muffler consists of a housing 1 which is formed in the shape of a cylinder with its ends 2 and 3 formed into a hemispherical shape. An inlet opening 4 is formed in one end and an oulet opening 6 is formed in the other end. A tubular member 7 is connected to the inlet opening so that no gases enter the housing except through the tubular member. The inlet opening is connected to the engine of the automobile by standard piping. An elongated rod member 8 having an end 17 with a helical member 9 is mounted within the tubular member so that all gases from the engine travel a spiral path as directed by the helix member and indicated by the arrow 11. Both the rod and helix member extend beyond the end of the tubular member into central converberation chamber 24 which extends from the end 16 of tubular member 7 to the end 26 of outlet tube 22. A counter-flow reverberation chamber, here shown as an annular chamber 12 surrounds the tubular member which consists of the smooth inner walls 13 of the housing and the smooth outer walls 14 of the tubular member. An elongated tubular outlet tube 22 is connected to the outlet opening 6 of the elongated tubular housing 1 and extends into the directional flow reverberation chamber 23. There is no baffling or other restriction between the three chambers and they are freely open to and communicate with one another.

Tubular member 7 may have a length which is two third ($\frac{2}{3}$rds) the length of the helical member. The helical member may have a length of about three fifths (3/5ths) the length of the housing. As stated above, there is no other sound attenuating material within the housing.

As an example, the diameter of the housing may range from three and one half inches to four inches ($3\frac{1}{2}$–4 in.) with a length of twelve to twenty-four inches (12–24 in.). The tubular member has an outside diameter of two inches (2 in.) and the helical member has an outside diameter of about one and seven eights inches ($1\frac{7}{8}$ in.) and extends about three inches (3 in.) beyond the end 16 of the tubular member. The tubular member 7 may have a length of from four to thirteen inches (4 to 13 in.). The outlet tube 22 may have a length of from two to six inches (2–6 in.). It should be noted that in constructing the mufflers of the present invention, both the tubular member and the outlet tubular member may be formed to extend beyond the housing for ease in connecting the muffler to the exhaust pipes.

EMBODIMENT OF FIGS. 11–13

Figure 11:
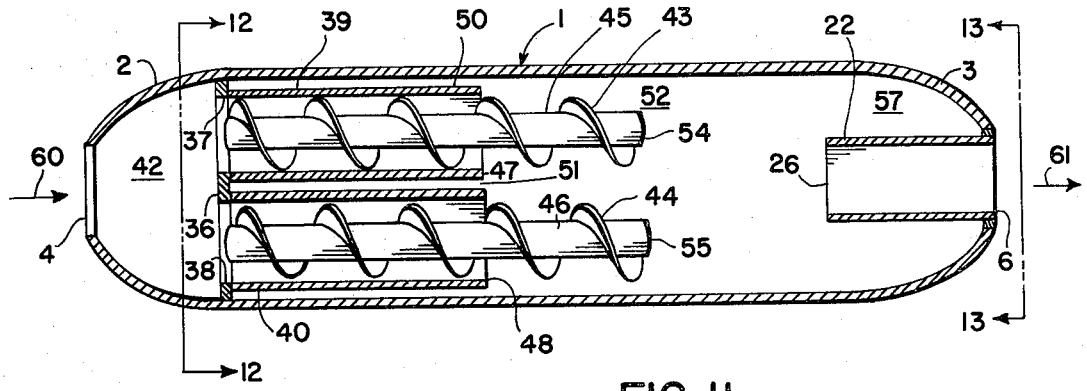
FIG. 11 is a cross sectional view of still another form of the invention.
Figure 12:
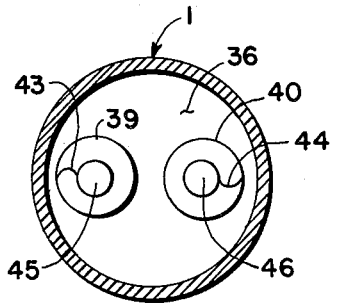
FIG. 12 is a cross sectional view taken along line 12—12 of FIG. 11.
Figure 13:
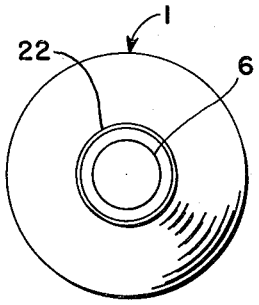
FIG. 13 is an end view taken along line 13—13 of FIG. 11.

Eight cylinder engines, because of their large displacement having been a special problem for muffler manufacturers but the present invention solves the noise problem by simply adding an additional gas flow channeling member as illustrated in FIG. 11. In this form of the invention, a bulkhead member 36 may be placed in the housing 1 at approximately the location that the housing reaches constant diameter. The bulkhead is formed with two openings 37 and 38 to receive the ends of tubular members 39 and 40. The space between the inlet opening 4 and the bulkhead 36 forms an inlet chamber 42. Preferably, an outlet tube 22 is connected to the outlet opening 6 and extends into the housing. As, in all forms of the invention, the helical members 43 and 44 and rods 45 and 46 extend beyond the ends 47 and 48 of tubular members 39 and 40. An irregular annular counterflow reverberation chamber 50 surrounds the twin tubular members 39 and 40 and there is a space 51 between the tubular members. Central reverberation chamber 52 surrounds the exposed helical members and extends from ends 47 and 48 of tubes 39 and 40 to end 26 of tube 22. At the end of the muffler, directional-flow reverberation chamber 57 surrounds the outlet tubular member 22. The dimensions of the muffler are by way of example only. All dimensions may be the same as the dimensions of the muffler illustrated in FIGS. 7–10 except that the diameter of the housing may be from four and one half to five inches ($4\frac{1}{2}$–5 in.) and the diameter of the inlet and outlet opening may be from two to two and one half inches (2–$2\frac{1}{2}$ in.). The dimensions of the tubular members, rods and helical members are the same as the muffler illustrated in FIGS. 7–10.

All of the mufflers described in this application may have a rod member with a diameter of about seven eights of an inch ($\frac{7}{8}$ in.).

In operation, exhaust gases from an internal combustion engine enter the mufflers illustrated in FIGS. 7–13 at their inlet ends in the direction of arrow 60 indicated on the drawings and exit the muffler via the outlet end in the direction of arrow 61.

Figure 7:
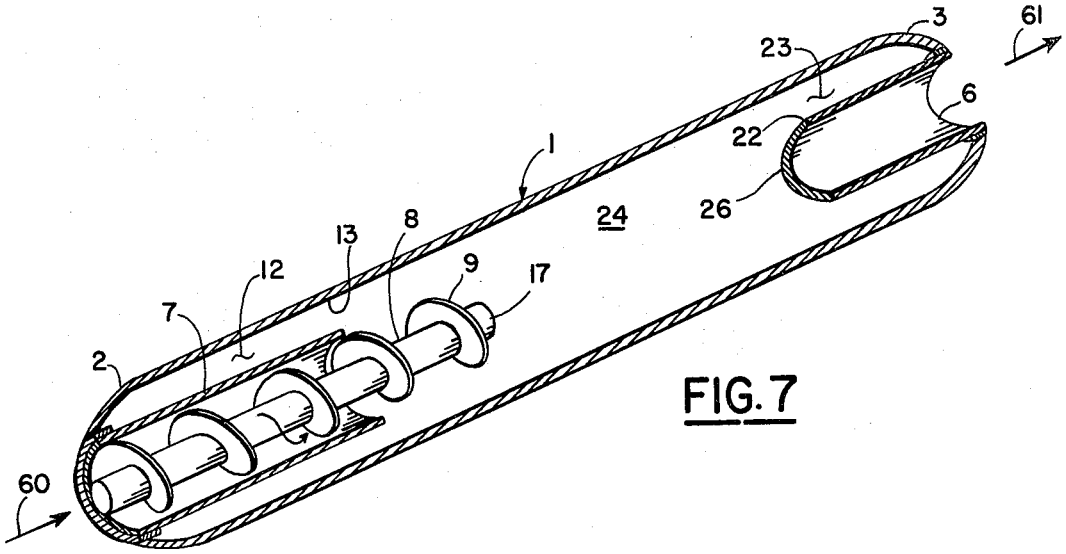
FIG. 7 is a perspective view of an another alternate invention with portions in cross section.
Figure 8:
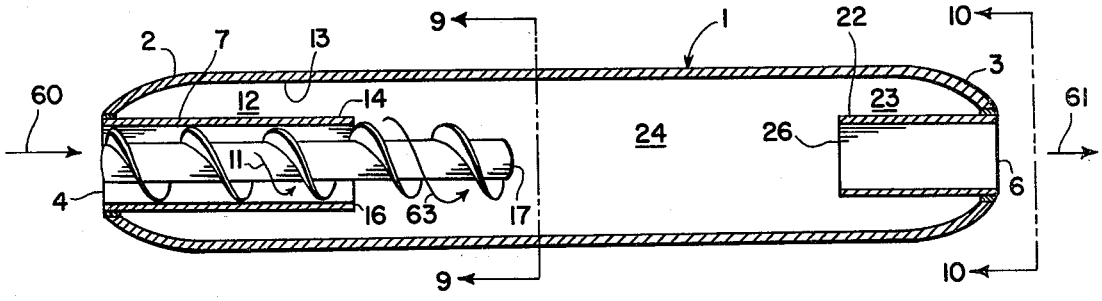
FIG. 8 is a cross sectional view of the invention shown in FIG. 7.
Figure 9:
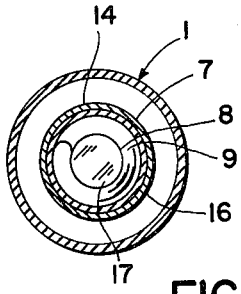
FIG. 9 is a cross sectional view taken along line 9—9 of FIG. 8.
Figure 10:
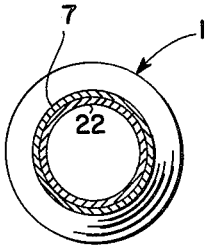
FIG. 10 is an end view taken along line 10—10 of FIG. 8.

Referring to FIGS. 7 and 8, the hot exhaust gases, which in most cases are already in a spiral pattern, are forced to follow a defined spiral pattern as indicated by arrows 11 to conform to the helix shape of the helical member 9. As the gas exists the end 16 of the tubular member, the gas is permitted to expand and since it is no longer forced to follow a restricted spiral course, it follows a larger spiral course as indicated by the arrow 63. As the hot gases leave the end of the helical member 9 and enter chamber 24 they strike the inner walls of the housing and are reflected back toward the center of the muffler. Finally, as the exhaust gases reach the hemispherical end 3 of the housing, the decreased cross sectional diameter of the muffler causes the exhaust gases to compress. Some of the sound waves strike the hemispherical end portion of the housing and are reflected at a sharper angle toward the center of the muffler. Some of the sound waves will exit through the outlet member but some will be reflected back through the exhaust gases and enter chamber 12 where they will strike the closed end 2 of the chamber and again are reflected back through the muffler. As may be understood, there is much turbulence within the muffler as well as a constant changing of pressure in different parts of the muffler. The turbulence and multiple changes of pressure cause the sound waves to interfere with one another in a manner not fully understood so that there is an attenuation of the sound emitted by the engine.

The presence of the outlet tubular member 22 forms a chamber 23 which causes further turbulence at the outlet opening and causes sound waves entering annular chamber 23 to be reflected back and forth off the walls of the tubular member and the inner walls of the housing as well as being reflected back from the hemispherical portion 3.

The muffler illustrated in FIG. 11 presents a very complex flow pattern with a resultant very turbulent mixing of the exhaust gases. The presence of the twin helical members requires a bulkhead 36 which provides an additional reflecting surface within chamber 42. As the gases exit the tubular members 39 and 40 they mix immediately with the gases flowing in a spiral pattern through the outer tubular member. The gases follow a completely random path which is not illustrated by any arrow in chamber 52. Some sound waves exit the outlet tube 22 on the first pass, but many of the sound waves are reflected in the chamber 57 bounded by the inlet end 26 of the outlet tube and the intersection of the hemispherical end with the end 6 of the outlet tube. Sound waves are reflected back through the sound waves traveling toward the exit end and some reach the inside wall face of the bulkhead member 36. It is known that the interference of the sound waves in the extremely turbulent exhaust gases in some way attenuate the sound to acceptable noise levels.

EMBODIMENT OF FIG. 14

Figure 14:
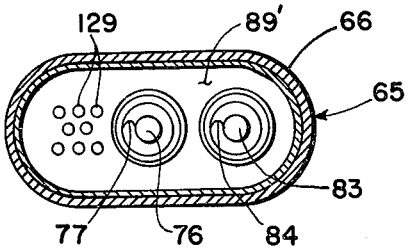
FIG. 14 is an alternate form of the invention set forth in FIGS. 1-3. The modification relates to the area illustrated in FIG. 2.

FIG. 14 illustrates a modified form of the invention set forth in FIGS. 1–3. The modified form is identical to the form shown in FIGS. 1–3 except that instead of plate 89 being solid and forcing all inlet gases through the flow channeling members, openings such as perforations 129 may be formed in plate 89' so as to permit some inlet gases to flow directly into the counter-flow chamber 69.

We claim:

1. An internal combustion engine muffler comprising:

a. an elongated housing having an inlet opening and a rear plate formed with an outlet opening; and including a counter-flow reverberation chamber, a double open ended central chamber extending from said counter-flow chamber to a substantial distance from said rear plate and communicating with said counter flow reverberation chamber and a directional-flow reverberation chamber formed between said rear plate and said central chamber having a closed end and an open end in communication with said central chamber;

b. a first gas flow channeling member including, (1) an elongated unperforated tubular member having a diameter and a length substantially less than the smallest cross sectional dimension and substantially less than the length of said elongated housing and having an inlet end in communication with said inlet opening of said housing, and an outlet end terminating at the downstream end of said counter-flow reverberating chamber and co-extensive with the upstream end of said central chamber and in communication with said central chamber;

(2) an elongated rod member having a diameter less than the diameter of said elongated tubular member, (3) a helix member connected to said rod member and having an outer diameter substantially equal to said inside diameter of said elongated tubular member and extending along a substantial portion of said tubular member and extending a substantial distance beyond the downstream end of said tubular member;

c. inflow means connecting said gas flow channeling member to said housing causing substantially all of the exhaust gases from said internal combustion engine to flow through said gas flow channeling member, and said inflow means including a wall forming the upstream end of said counter-flow reverberation chamber; and d. an outflow tubular member connected to said housing at said outlet opening and extending through said directional-flow reverberating chamber and communicating with said central chamber, and said upstream end of said out flow tubular member is located at the downstream end of said central chamber and the upstream end of said directional-flow reverberating chamber.

2. An internal combustion engine muffler as described in claim 1 wherein:

a. said housing has a tubular cylindrical shape; and b. said helix member extends substantially the entire length of said tubular member.

3. An internal combustion engine muffler as described in claim 1 wherein:

a. said housing has an oval-like shape;

b. said helix member extends a substantial distance beyond said downstream end of said tubular member into the mid-portion of said central chamber.

4. An internal combustion engine muffler as described in claim 2 wherein:

a. said elongated tubular member is connected to said inlet opening of said elongated tubular housing and the diameter of said elongated tubular member is substantially equal to said diameter of said inlet opening; and b. said inflow means causes all of said exhaust gas from said engine to flow through said flow channeling member.

5. An internal combustion engine muffler as described in claim 4 wherein:

a. the length of said elongated tubular member is approximately two third ($\frac{2}{3}$rds) the length of said elongated rod member and said helix member; and b. the length of said elongated rod member and helix member is approximately three fifths (3/5ths) the length of said elongated tubular housing.

6. An internal combustion engine muffler as described in claim 5 wherein:

a. the diameter of said elongated tubular housing is approximately 1.75 times the diameter of said elongated tubular member of said gas flow channeling member.

7. An internal combustion engine muffler as described in claim 6 wherein:

a. said elongated tubular housing has a length of about twenty (20) inches and a diameter of about three and a half inches ($3\frac{1}{2}$ in.).

8. An internal combustion engine muffler as described in claim 2 comprising:

a. a second gas flow channeling member; and b. said inflow means is connected to said oval housing at a location spaced from said inlet opening forming a pre-chamber.

9. An internal combustion engine muffler as described in claim 3 comprising:

a. a second gas flow channeling member; and b. said inflow means includes a bulkhead member connected to said oval housing spaced from said inlet opening and a front plate forming a pre-chamber in communication with said gas flow channeling members.

10. An internal combustion engine muffler as described in claim 9 comprising:

a. said gas flow channeling members are offset from the axis of said housing;

b. said inlet opening in said housing is generally in alignment with said gas flow channeling members; and c. said bulkhead member causes all of said exhaust gas from said engine to flow through said flow channeling member.

* * * * *